United States Patent [19]

Korf

[11] 4,188,720

[45] Feb. 19, 1980

[54] STYLIST HAIR CLIPPER

[76] Inventor: Anahid Korf, 3131 Xenophon St., San Diego, Calif. 92106

[21] Appl. No.: 918,007

[22] Filed: Jun. 22, 1978

[51] Int. Cl.[2] ..... B26B 19/44

[52] U.S. Cl. ..... 30/133; 30/210

[58] Field of Search ..... 30/41.5, 133, 124, 210

[56] References Cited

U.S. PATENT DOCUMENTS

| | | | |
|---|---|---|---|
| 1,730,889 | 10/1929 | Hoberecht | 30/133 |
| 2,323,046 | 6/1943 | Jenkins | 30/133 |
| 3,241,234 | 3/1966 | Kiefer | 30/133 |
| 3,302,286 | 2/1967 | Zucker | 30/133 |
| 3,979,825 | 9/1976 | Baumann | 30/133 |
| 4,005,526 | 2/1977 | Clay | 30/133 |
| 4,077,122 | 3/1978 | Rollor | 30/133 |

*Primary Examiner*—Gary L. Smith

*Attorney, Agent, or Firm*—Henri J. A. Charmasson

[57] ABSTRACT

A hair clipper utilizes a vacuum source to draw hair into a substantially enclosed flow chamber where the substantially parallel hairs are cut by a shearing blade which moves perpendicularly across the hair flow to cut the hair to precisely equal lengths which are necessary in certain hairdos.

8 Claims, 11 Drawing Figures

STYLIST HAIR CLIPPER

BACKGROUND OF THE INVENTION

Certain of the hairstyles which are currently popular require that the hair be cut to fairly precisely equal lengths in order for the hairdo to be effective. It is, of course, quite difficult to accurately judge the relative lengths of different shocks of hair when the cutting is being done by the comb and scissors method, one shock of hair at a time. The result is a hair style that is less than it could be due to the slight irregularity presented in the lengths of the hair.

Without a doubt certain jigs, spacers and braces have been developed and experimentally used in combination with scissors or electric clippers, and several clipping assemblies utilizing a source of vacuum have been developed as is evidenced by U.S. Pats. Nos. 3,138,870, 2,980,994, and 2,807,086. These latter mentioned devices, those utilizing a vacuum source, do so to the end of collecting the cut hair in an orderly manner, and in one instance the cutting blade is ostensibly powered by a turbine connected to the vacuum source. Because of the structure of these devices and the rotary nature of the blades used in conjunction with the vacuum system, they are not particularly adapted for haircutting when the length of the cuts must be precisely uniform over the entire head or at least a large portion of it.

SUMMARY OF THE INVENTION

The present invention is directed toward the previously mentioned failings in the prior art and provides an electric hair clipper which utilizes a source of vacuum to serve the dual functions of aligning the hair in an orderly and parallel fashion and collecting the cut ends as the haircut progresses. By providing an unobstructed open air flow passage in which the hair is drawn by the vacuum source and can lie flat and even, and by cutting the hair so extended by a straight oscillating blade that moves precisely orthogonally to the air chamber, a capability of very precisely cutting the hair to the same length is provided in combination with utter simplicity and speed in the actual operation and use of the clipper.

BRIEF DESCRIPTIONS OF THE DRAWINGS

DETAILED DESCRIPTION OF THE PREFERRED EMBODIMENT

Figure 1:
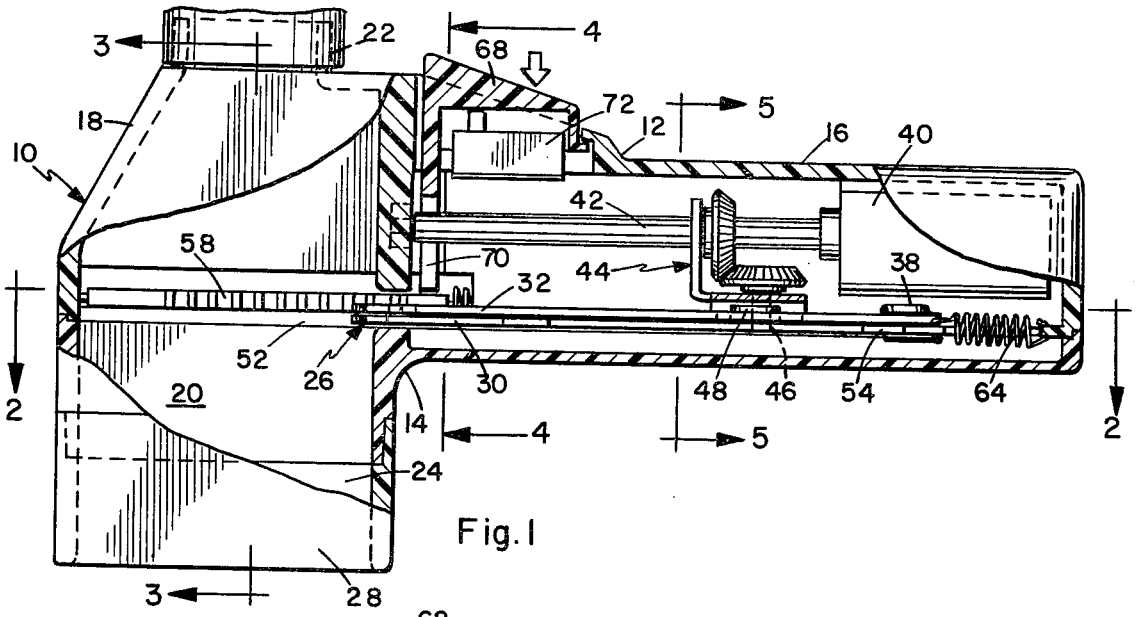
FIG. 1 is a side elevation view of the hair clipper, with portions cut away.

The first of the two principal embodiments in which the invention is disclosed is shown in FIGS. 1 through 5 wherein a housing 10 mounts all of the structure of the clipper. The housing is adapted to be provided in molded plastic or the like and comprises a top half 12 and a bottom half 14 which together define a handle portion 16 and a head 18 within which is defined a flow chamber 20.

The upper end of the flow chamber will be termed the suction end because it attaches to a vacuum source 22 which creates an air flow which draws hair into the flow chamber through the open applicator end 24. Once the hair is drawn within the flow chamber, it is severed by a blade 26 which progresses orthogonally across the flow chamber to cut the hair to precisely even lengths.

It is important to the proper result being achieved that the hair be drawn up generally perpendicularly from the scalp, and that it be maintained generally parallel while it is cut by the substantially linear blade 26. To this end, the applicator end of the flow chamber is made smooth and parallel-walled to encourage the parallel alignment of the hair entrained therein.

Also, as adjustability is a desirable if not essential feature in a clipper of this type, a replaceable skirt or sleeve 28 comprises the lower portion of the flow chamber and can be interchanged with similar skirts of varying lengths with the result of providing the capability of different lengths of cut. It would also be possible to incorporate in the sleeves as well as in other parts of the chamber-defining portions of the housing a plurality of air vents to permit the ingress of air adjacent the scalp to insure a smooth air stream within the flow chamber during the entire cutting operation; even when the mouth of the sleeve 28 is pressed against the scalp.

Turing now to the mechanism for the cutting blade and the advancement of same, the blade indicated at 26 actually comprises a pair of individual blade elements, a stationary element 30 and a blade 32 which oscillates on top of blade 30 to create the desired shearing action at the teeth 34. Both blades have large interior voids 36 so that the air flow in the flow chamber is interrupted as little as possible with the passage of the blade thereacross.

These two blades in the first embodiment are pivoted together at 38. A motor 40 having a spline shaft 42 is used to power the oscillations of the two blades as well as the translational motion. Oscillation is achieved by the bevel gear rider mechanism 44 which is driven by the spline shaft and operates a short vertical drive shaft 46 which is journalled at its lower end in the stationary blade 30. As this shaft is rotated by the bevel gear rider mechanism 44, a cam 48 eccentrically mounted on the shaft operates within an elongated cam follower hole 50 in the moving blade to cause the necessary oscillation thereof.

The lower blade element 30 is stationary only in the sense that it does not oscillate, and the rearward portion of the blade element is a planar slide 52 having laterally extended tabs 54 which are keyed into opposing guideways 56 to permit free motion of the slide together with its parasitically mounted upper blade in one dimension, orthogonally to the direction in which the flow chamber extends.

A climbing rack gear mechanism is provided for advancing the oscillatory blade elements 30 and 32 across the flow chamber. Two parallel racks 58 are pivotally mounted on axes 60. The teeth of each rack are offset by half a step relative to the teeth of the other rack.

Figure 2:
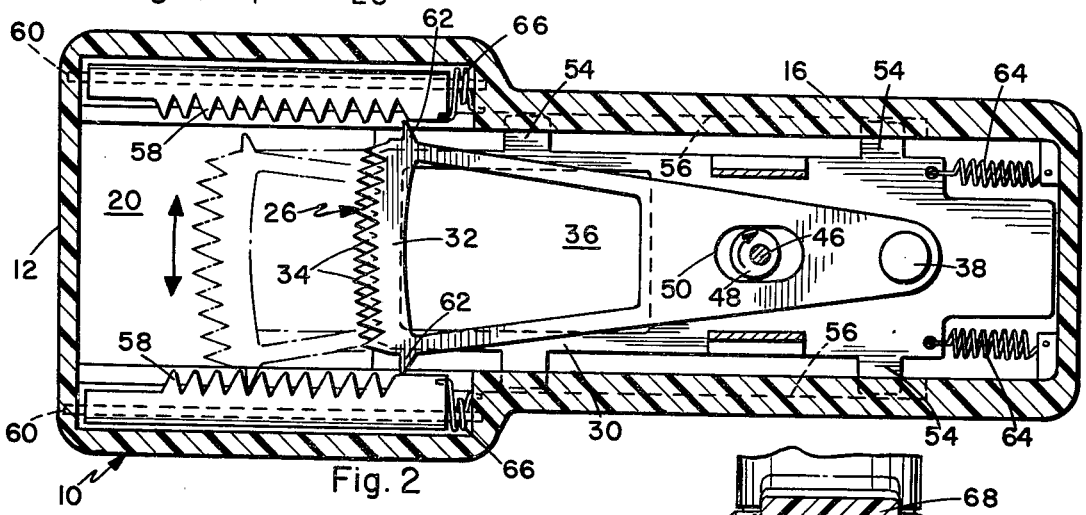
FIG. 2 is a sectional view taken on line 2—2 of FIG. 1.

Thus it can be visualized from FIG. 2 that as the oscillatory blade 32 oscillates, a pair of extending pawls engage alternately in first the left and then the right rack in a rapid fashion causing the blade elements to advance to the left in FIG. 2 against the restraining action of return springs 64. After the blade elements have traversed the flow chamber, there are no more teeth on the rack gears so the moving blade oscillates uselessly until the mechanism is returned.

Figure 3:
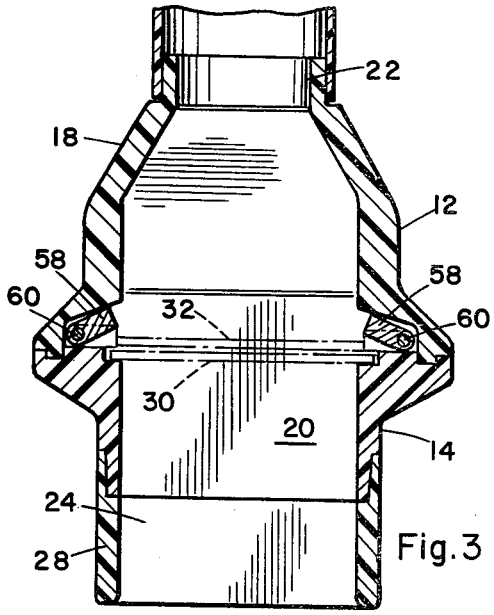
FIG. 3 is a sectional view taken on line 3—3 of FIG. 1.
Figure 4:
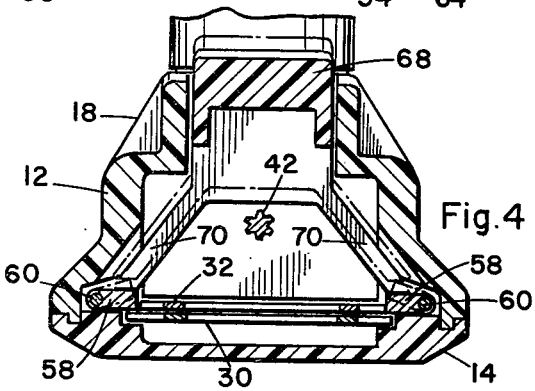
FIG. 4 is a sectional view taken on line 4—4 of FIG. 1.
Figure 5:
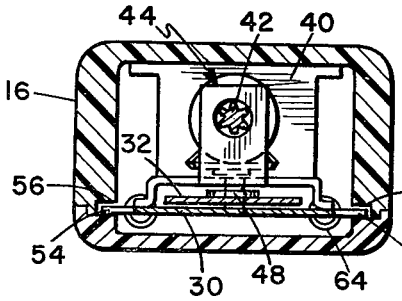
FIG. 5 is a sectional view taken on line 5—5 of FIG. 1.

The return mechanism for the blades involves the rotation of the two racks on their pivotal axes free of the pawls 62 as is shown in FIGS. 3 and 4. A pair of springs 66 are utilized to maintain the racks in the free position shown in FIG. 3, but in order to cause the blades to climb the rack in the first place a thumb switch or button 68 is depressed which causes a pair of connected legs 70 which straddle the spline shaft to press the racks into operative position. Thus by releasing the button 68 after the blade elements have traversed the climbing racks, the racks swing upwardly free of the pawls and permit the return of the blade mechanism under the action of the springs 64.

There is also an electrical switch 72 which actuates the motor 40 so that the blade elements are not uselessly oscillating between strokes of the cutting edge. It should also be noted that because of this single stroke action, the clipper can be aligned with the head and hair until it is precisely at the right position and angle prior to triggering the cutting mechanism.

Figure 6:
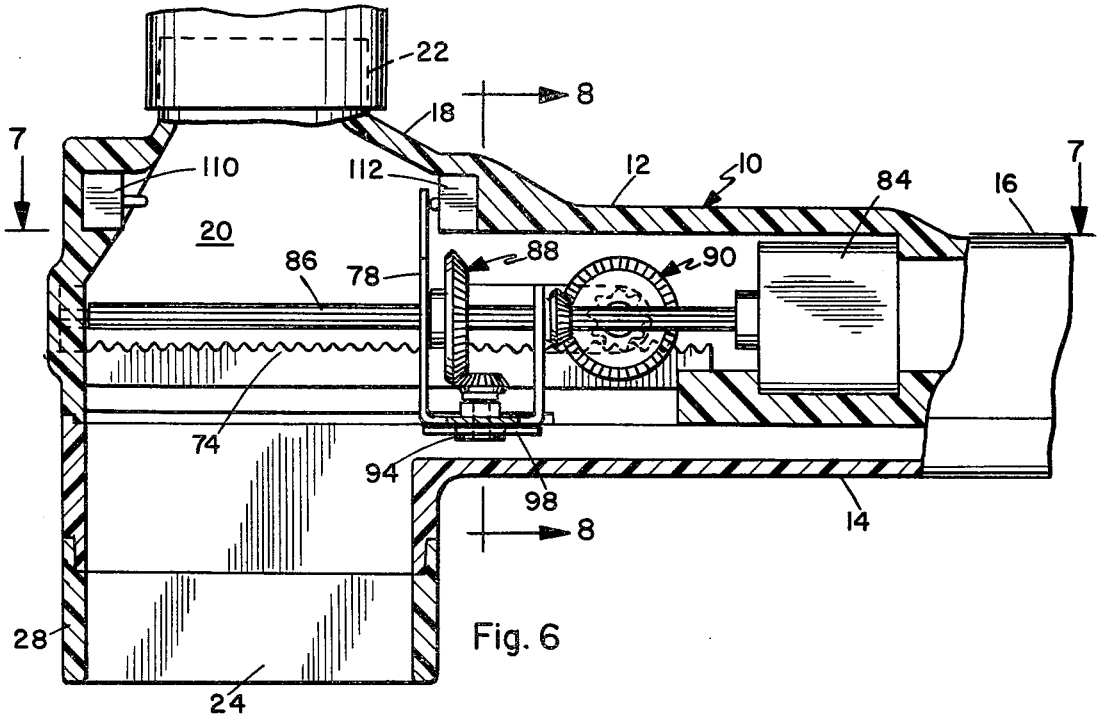
FIG. 6 is a side elevation view, with portions cut away, showing an alternative drive mechanism.
Figure 7:
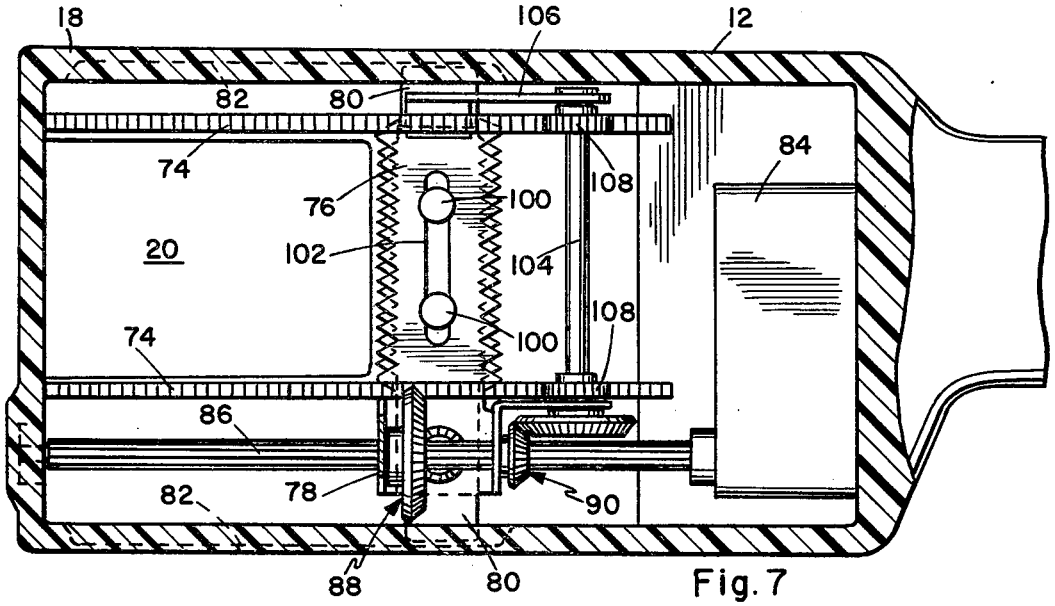
FIG. 7 is a sectional view taken on line 7—7 of FIG. 6.
Figure 8:
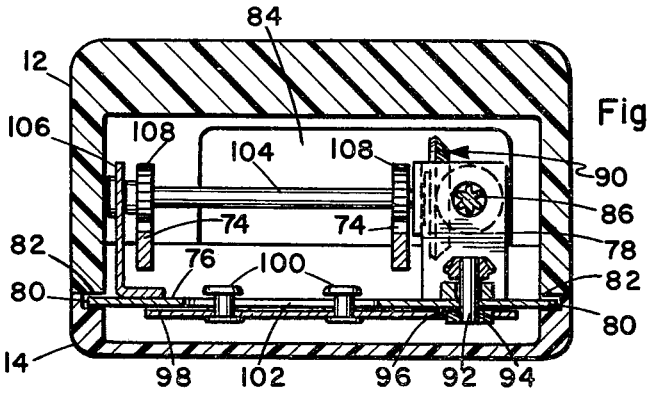
FIG. 8 is a sectional view taken on line 8—8 of FIG. 6.

FIGS. 6 through 8 show a slightly modified version of the cutting mechanism utilizing the same basic housing and flow chamber but a different arrangement of the cutting elements. In this embodiment two immovable racks 74 are mounted within the housing. A non-oscillating upper blade 76 is suspended beneath the racks on a frame 78 which includes tabs 80 which are keyed into guide slots 82 so that the framework and the upper blade move forward and back freely.

A motor 84 has a spline shaft 86 arranged similarly to the first embodiment. As is best seen in FIG. 7 there are two bevelled gear rider mechanisms 88 and 90 which are mounted on the frame 78 and driven by the spline shaft. The first of these riders powers a vertical shaft 92 which drive a cam which rides in a cam follower hole 96 in a lower oscillatory blade 98 which is connected to the upper stationary blade 76 by means of rivets 100 which slide in a slot 102 provided in the upper blade.

The second bevelled gear rider 88 powers a horizontal drive shaft 104 which is journalled at both ends in extension arms 106 of the framework 78. This shaft has two spur gears 108 which climb the two racks and translate the cutting mechanism across the flow chamber. It will be noted that the two blades 76 and 98 are double edged and are effective when traversing the open space in either direction. In order to effect the reversal of the motion, reversing limit switches 110 and 112 are provided which simply reverse the direction of the current to motor, which operates on converted DC.

The two methods of actuating the oscillatory cutting blades and for traversing the hair to be cut are subject to some variation within the scope of the appended claims. The hair clipper which results from either of the constructions shown or from an equivalent mechanism provides a simple and virtually foolproof device for the cutting of hair to precisely equal lengths and will provide an indispensable tool for all hair stylists and barbers, as well for home use.

Figure 9:
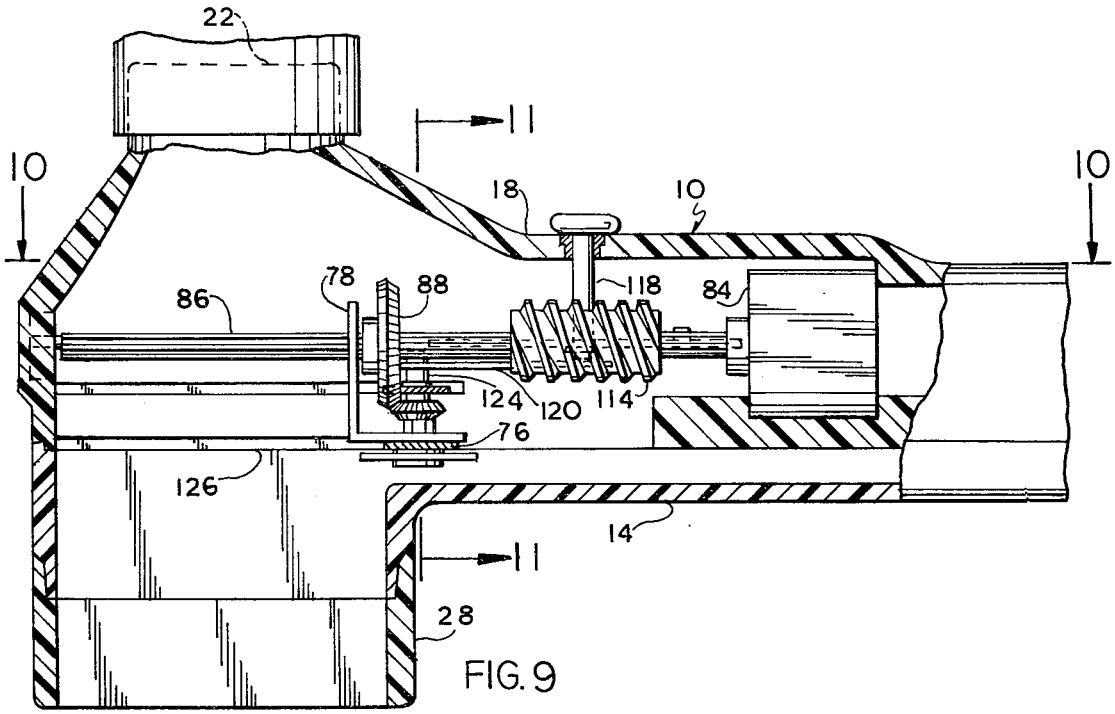
FIG. 9 is a side elevation view, with portions cut away, of a modified drive mechanism.
Figure 10:
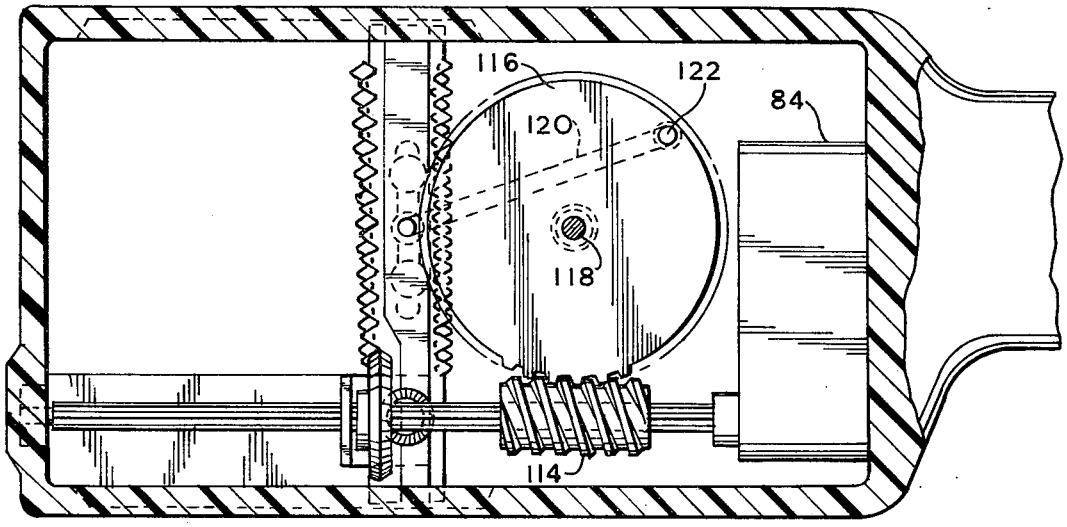
FIG. 10 is a sectional view taken along lines 10—10 of FIG. 9.
Figure 11:
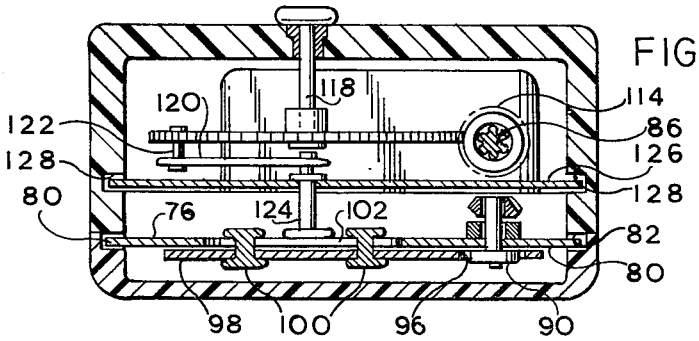
FIG. 11 is a sectional view taken along line 11—11 of FIG. 10.

A slight variation of the second embodiment shown in FIGS. 6 through 8 is illustrated in FIGS. 9 through 11 wherein the basic oscillatory mechanism utilizing the bevelled gear rider mechanism 88 is used to reciprocate the two blade elements 76 and 98. These blade elements are held together by the same rivet structure 100, and the bevel rider is driven by spline shaft 86 as has already been described.

However, a variation involves the provision of a worm gear 114 which is fixedly mounted on the spline shaft 86 tangentially engaging spur gear 116 which is journaled on a vertical shaft 118 mounted in the casing head 18 or otherwise appropriately journaled in a fixed member in the cutter housing.

A push rod 120 is connected by means of an eccentrically mounted pivot pin 122 to the spur gear at one end, the other end being connected either directly, or indirectly as shown through a vertical connector pin 124 to the upper blade 76. This vertical connector pin is fixedly mounted to blade element 76, the top being journaled in the push rod 120 and having an additional central support brace 126 into which this connector pin is journaled. This brace slides in opposed parallel slots 128.

Thus, it can be seen that in this modification of the second embodiment, so long as the motor 84 drives the spline shaft 86 the bevel gear rider mechanism 88 insures that the blades reciprocate causing the teeth thereof to sheer back and forth in a cutting action. Simultaneously, the worm gear 114 engages the teeth of the spur gear 116, actuating the push rod 120 causing the longitudinal advancement and retreat of the cutting blade mechanism at a rate much reduced from the oscillation frequency of the cutting blade.

The action just described is of course continuous, differing from the "single-shot" action of the first embodiment and perhaps being simpler in format than the other version of the second embodiment. Undoubtedly, there are other valid means of causing the simultaneous reciprocating shearing action of the blades and the two-fro stroking action of the entire blade assembly to traverse the flow chamber 20 and thus cut any hair entrained therethrough. Such variations would, of course, fall within the scope of the generic claims appended hereinafter.

I claim:

1. A precision hair clipper for cutting hair to an uniform length at a selectable spacing from the scalp, said clipper comprising:

(a) a housing defining a tubular flow chamber having an applicator end and a suction end connectable to a source of vacuum, said housing having a projection extending laterally from said tubular flow chamber holding drive means elements;

(b) an oscillating blade mounted in said housing lying in a plane intercepting said flow chamber orthogonally, said blade comprising two complementing toothed blade elements; and (c) drive means which comprise an electrical motor stationarily mounted in said projection, means for translating the rotary motion of the motor into the reciprocal movement of one of said elements relative to the other in a shearing motion, rack means within said plane positioned orthogonally to the direction of said reciprocal movement, and propelling means associated with said blade and cooperating with said rack means for advancing said blade substantially orthogonally and linearly across said flow chamber in order to clip at uniform length generally parallely extending hair entrained through said flow chamber by air flow created by vacuum source.

2. Structure according to claim 1 wherein said blade elements are each double edged and provided with a row of cutting teeth on each edge so that said blade is effective in either of two opposite translational modes.

3. Structure according to claim 1 wherein the applicator end of said housing includes a removable sleeve replaceable with a sleeve from a selection of sleeves of different lengths, whereby the length to which hair is cut with said device is electable.

4. Structure according to claim 1 and including a switch for initiating a single translatory cutting stroke of said blade across said flow chamber.

5. A precision hair clipper for cutting hair to an uniform length at a selectable spacing from the scalp, said clipper comprising:

a housing defining a flow chamber having an applicator end and a suction end connectable to a source of vacuum;

an oscillating blade mounted in said housing which comprises two complementing toothed blade elements; and drive means for moving said elements relative to one another in a shearing motion and for advancing said blade substantially orthogonally and linearly across said flow chamber in order to clip at uniform length generally parallely extended hair entrained through said flow chamber by air flow created by said vacuum source, said drive means comprising a motor oscillating one of said blade elements relative to the other;

a pair of spaced parallel racks transversely extended across said flow chamber; and a pawl at each end of said one blade element to engage said respective racks such that a climbing rack is created to advance said blade across said flow chamber as said one blade element oscillates.

6. Structure according to claim 5 wherein each of said racks is pivotally mounted on its longitudinal axis and is pivotable from a position clear of said pawls to a position engaging one of said pawls; and including a mechanically linked switch controlling the pivotal mode of said racks.

7. A precision hair clipper for cutting hair to an uniform length at a selectable spacing from the scalp, said clipper comprising:

a housing defining a flow chamber having an applicator end and a suction end connectable to a source of vacuum;

an oscillating blade mounted in said housing which comprises two complementing toothed blade elements; and drive means for moving said elements relative to one another in a shearing motion and for advancing said blade substantially orthogonally and linearly across said flow chamber in order to clip at uniform length generally parallely extended hair entrained through said flow chamber by air flow created by said vacuum source, said drive means comprising:

a motor stationarily mounted in said housing;

a spline shaft extending from said motor alongside the path of advancement of said blade;

a rider on said spline shaft; and a bevel gear mechanism on said rider effective to interpret the rotational motion of said spline shaft into oscillatory and advancing movement of said blade elements.

8. A precision hair clipper for cutting hair to an uniform length at a selectable spacing from the scalp, said clipper comprising:

a housing defining a flow chamber having an applicator end and a suction end connectable to a source of vacuum;

an oscillating blade mounted in said housing which comprises two complementing toothed blade elements; and drive means for moving said elements relative to one another in a shearing motion and for advancing said blade substantially orthogonally and linearly across said flow chamber in order to clip at uniform length generally parallely extended hair entrained through said flow chamber by air flow created by said vacuum source, said drive means comprising:

a motor stationary mounted in said housing;

a spline shaft extending from said motor alongside the path of advancement of said blade;

a rider on said spline shaft;

a bevel gear mechanism on said rider effective to interpret the rotational motion of said spline shaft into oscillatory relative movement of said blade elements;

a worm gear fixedly mounted on said spline shaft;

a spur gear journaled in said housing and tangentially engaged by said worm gear; and a push rod pivoted eccentrically on said spur gear and pivoted to said blade to translate said blade to and fro across said flow chamber as said spur gear is rotated.

* * * * *